US005458334A

United States Patent [19]

Sheldon et al.

[11] Patent Number: 5,458,334

[45] Date of Patent: Oct. 17, 1995

[54] GOLF CLUB, AND IMPROVEMENT PROCESS

[76] Inventors: Gary L. Sheldon, 319 NW. 131st St., Vancouver, Wash. 98685; Robert D. Lloyd, 2015 C.R. 24, Marengo, Ohio 43334; Daniel B. Mitchell, 7675 Key Deer Dr., Wolthington, Ohio 43085

[21] Appl. No.: 141,787

[22] Filed: Oct. 21, 1993

[51] Int. Cl.[6] ..... A63B 53/04

[52] U.S. Cl. ..... 273/167 R; 273/167 J

[58] Field of Search ..... 273/167 R, 167 A, 273/167 B, 167 C, 167 E, 167 F, 167 G, 167 H, 167 J, 168, 78, 169, 170, 171, 172, 173, 174, 175, 193 R, 194 R, 77 R, DIG. 23

[56] References Cited

U.S. PATENT DOCUMENTS

| | | | |
|---|---|---|---|
| 2,908,502 | 10/1959 | Bradstreet | 273/DIG. 33 |
| 2,926,913 | 3/1960 | Stecher | 273/167 J |
| 3,218,072 | 11/1965 | Burr | 273/167 J |
| 4,768,787 | 9/1988 | Shira | 273/175 |
| 4,964,641 | 10/1990 | Miesch | 273/173 |
| 5,037,102 | 8/1991 | Fukayama | 273/173 |
| 5,131,986 | 7/1992 | Harada | 273/167 H |
| 5,207,427 | 5/1993 | Saeki | 273/167 R |

FOREIGN PATENT DOCUMENTS

| | | | |
|---|---|---|---|
| 4-04332572 | 11/1992 | Japan | 273/167 R |

*Primary Examiner*—Sebastiano Passaniti

*Attorney, Agent, or Firm*—Wells, St. John, Roberts, Gregory & Matkin

[57] ABSTRACT

A golf club which generally includes a shaft, a grip and a clubhead, which includes a sole, a back and a clubface. The surface layer of the clubface of the golf club is a substantially harder material than the material generally comprising the clubhead. The process for imparting the substantially harder material onto and to become a part of the surface layer of the clubface generally includes micro-welding an electrode material to the surface of the clubface. The micro-welding process can be any one of a number of known micro-welding processes, such as electro-spark deposition, or others. The electro-spark deposition process generally includes the utilization of an electrode, through which short duration, high amperage charges are directed through the electrode and the clubhead. Extremely short duration discharges at high discharge frequencies result in deposition of the electrode material onto the clubface of the golf club, such that it becomes micro-welded.

13 Claims, 1 Drawing Sheet

GOLF CLUB, AND IMPROVEMENT PROCESS

FIELD OF THE INVENTION

This invention generally pertains to a golf club in which the outer surface layer of the clubface is substantially harder than the metal comprising the clubhead, and in which the outer layer is fused with the material generally comprising the clubhead. This invention also includes the process for the application of the outer surface layer to golf clubs.

BACKGROUND OF THE INVENTION

The popularity of the game of golf as a participation sport has proliferated over the past several years. Golf is played with three types of clubs which are generally referred to as woods, irons and putters. The term wood generally refers to a mallet-type headed club. With the increased use of metal alloys and other materials for use in the construction of the head, the term wood may now be somewhat misleading as they are often times now called metal woods.

For several years now there has been a growing dichotomy in golf clubs between what is generally referred to as a forged clubhead, constructed through a metal forging process, and cast clubheads, which are generally manufactured using an investment casting process, most commonly the "lost wax" investment casting process. There can be a substantial relative variation in the hardness of the relative types of clubheads, which consequently results in differences in how the club "feels" as the golf ball is struck.

In many cases, more advanced golfers have continued to use their forged clubs because of their softer and better feel, although the clubheads have generally not been as forgiving to the golfer in the resultant shots hit. Some manufacturers have turned to different types of metals and alloys to achieve a happy medium, and have used copper beryllium as the material casted.

Naturally, the softer the metal comprising the clubhead and clubface, the more susceptible it is to wear from hitting balls, tees, dirt, rocks and the like, which tends to lessen the performance on allowable grooves on the spin of the golf ball as it leaves the clubface, which is not desirable. However, even the harder metals used wear and our invention can improve those clubs as well.

It is further believed by many that using harder metals in clubheads results in causing the ball to travel further, as compared to a softer metal clubface, and assuming equal impacts. It is our belief that utilizing a harder surface material on the clubface will likewise then result in improved distance.

Our invention is intended to and does substantially reduce or eliminate the wear problem currently experienced by substantial play on existing metal clubs, particularly irons.

Our invention is also intended to allow a clubhead comprised of softer metals to be given a hardened striking surface, thus providing a club which has the hardness on the surface of the clubface where it is needed, yet which also has the softness or "feel" of a clubhead comprised of a softer metal.

Our invention is further intended, by providing the increased surface hardness, to result in greater distance to the golfer for the same impacts, as compared to golf clubs comprised of the same base metal, only without this hardened clubface surface.

Our invention substantially improves upon the previously used clubheads in the foregoing ways by providing a golf club in which the clubface surface has been hardened, whether by electro-spark deposition, or by other known processes. Our invention generally involves the process of imparting such a hardened surface on the clubface by the electro-static deposition of electrode materials onto and mixing with the existing clubhead metal, a micro-welding process whereby the material comprising the electrode is essentially welded to and into the surface of the clubface, resulting in a relatively smooth surface similar to a sand blasted surface.

Our invention further allows most golfers to achieve proper spin on the golf ball more consistently as a result of the foregoing, and allows value to be added to used clubs so that they can be used longer or be resold easier.

SUMMARY OF THE INVENTION

Our invention generally includes the typical elements of a golf club, namely a shaft, a grip and a clubhead, the clubhead further made up of a sole, a back and a clubface. Additionally, however, our invention provides a golf club in which the outer surface of the clubface is substantially harder than the metal comprising the clubhead. The clubface of the golf club contemplated by our invention has a substantially harder material fused to it, such that the substantially harder material fuses with and becomes part of the surface of the clubface. The resulting clubface is a homogeneous, hard material.

The process to alter the surface hardness of the clubface is generally a fusion process, which can be any one of a number of known processes, such as micro-welding, electro-spark deposition (sometimes also referred to as electro-spark alloying), or by other known means, within the contemplation of our invention.

It is an object of this invention to provide a golf club which has the great "feel" of clubs made of softer materials, but which also possesses superior wear characteristics and superior distance normally attributable to clubs comprised of the harder materials. Our invention has the advantage of having the combination of the softer material for the vast majority of the clubhead metal, but also having a substantially harder surface layer on the clubface. This unique combination gives the preferred feel of the clubheads made of softer material, while still giving the additional distance and wear resistance of clubheads made of the harder materials, and will improve the wear resistance of even the hardest clubs known to applicants today.

It is an object of this invention to provide a golf club that causes the ball to spin more consistently when hit by average golfers, without requiring them to resort to golf clubs which compromise the feel. An advantage of our invention is that it greatly reduces or eliminates the wear problem on the clubface, thereby eliminating the loss in spin with wear and consequently resulting in a more consistent spin over a longer life of the club. Another related advantage is that eliminating wear on the most used part of the clubface will eliminate having inconsistent spin results depending on where on the clubface the ball is struck.

Other objects, features and advantages of this invention will appear from the specification, claims and accompanying drawings which form a part hereof. In carrying out the objects of this invention, it is to be understood that its essential features are susceptible to change in design and structural arrangement with only one preferred embodiment being illustrated in the accompanying drawings, as required.

BRIEF DESCRIPTION OF DRAWINGS

In the accompanying drawing which forms a part hereof.

DESCRIPTION OF THE PREFERRED EMBODIMENT

Figure 1:
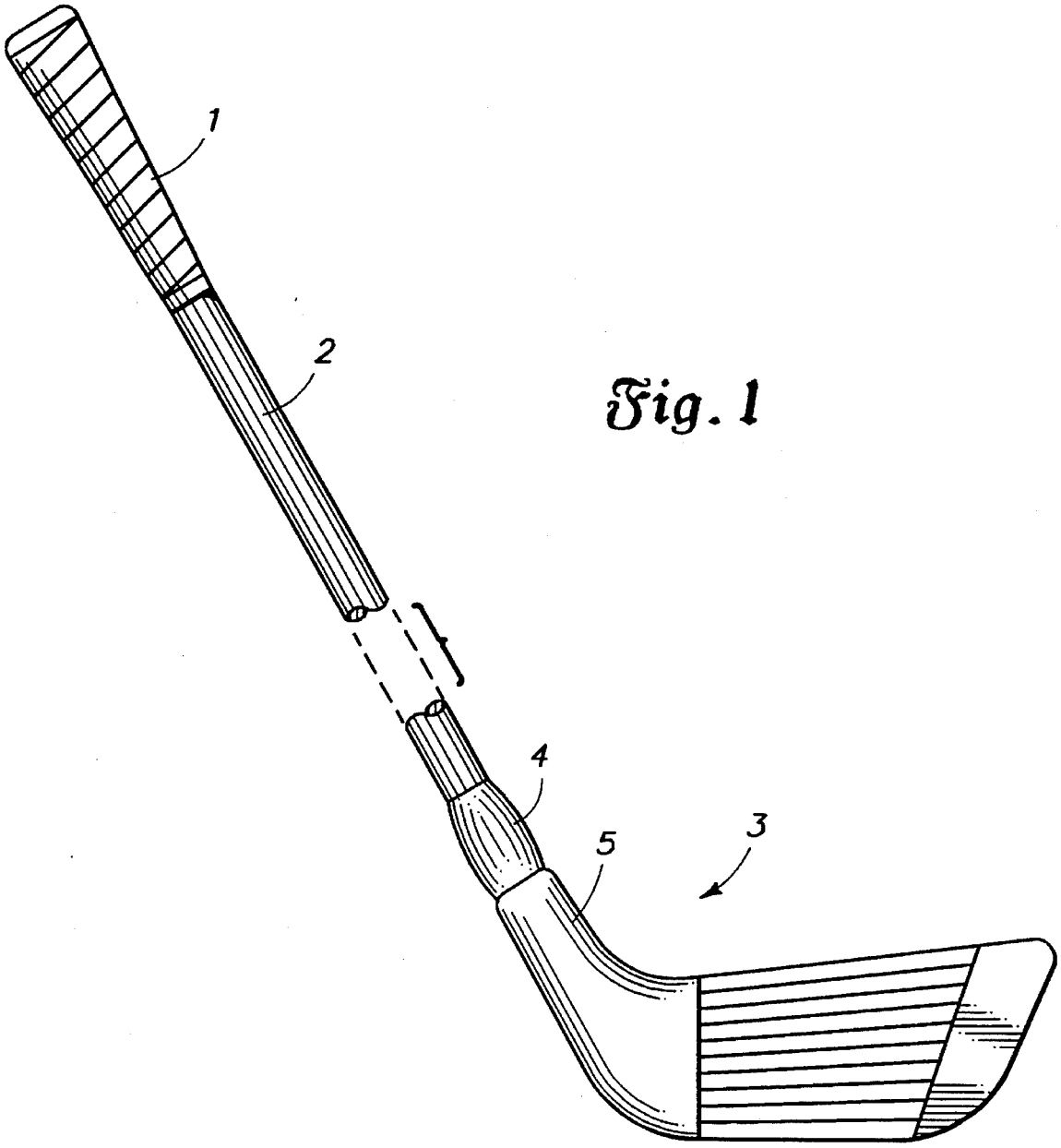
FIG. 1 is a perspective view of a typical golf club referred to as an iron.

This invention generally pertains to a golf club comprising the typical golf club elements, namely a shaft, a grip and a clubhead, the clubhead further made up of a sole, a back and a clubface. Additionally, however, our invention provides a golf club in which the outer surface of the clubface is substantially harder than the metal comprising the clubhead. The clubface of the golf club contemplated by our invention has a substantially harder material fused to it, such that the substantially harder material fuses with and becomes part of the surface of the clubface.

The process to alter the surface hardness of the clubface is generally a fusion process, which can be any one of a number of known processes, such as micro-welding, electro-spark deposition (sometimes also referred to as electro-spark alloying), or by other known means, within the contemplation of our invention.

Many of the fastening, connection, welding, process, welding and other means and components utilized in this invention are widely known and used in the field of the invention described, and their exact nature or type is not necessary for an understanding and use of the invention by a person skilled in the art or science, and they will not therefore be discussed in significant detail.

The various components shown or described herein for any specific application of this invention can be varied or altered as anticipated by this invention. This invention comprises a unique combination of elements, each element of which can be accomplished by one of several different means or variations for a specific application of this invention. The practice of a specific application of any element may already be widely known or used in the art or by persons skilled in the art or science and each will not therefore be discussed in significant detail.

This invention generally includes the basic components of a golf club, which are: a shaft, a grip and a clubhead. There are many variations and different types of shafts, grips and club heads, most if not all of which can be used in conjunction with my invention.

There are certain variations or modifications which can be made to these generally known components to facilitate different applications of this invention without changing the nature of what is claimed by this invention, as is set forth more fully herein.

Although the majority of the description contained herein is directed toward the golf club referred to as an iron, this invention is not limited to irons and specifically also includes woods (metal woods), and the description applies equally regardless of what type of club, i.e. iron or wood.

FIG. 1 shows a typical golf club referred to as an iron and its components, namely a grip 1, a shaft 2 and a clubhead 3. FIG. 1 also shows the hosel 4 of the club and the neck 5 of the clubhead.

The grip 1 is a well known product in the industry, with there being numerous different types, any of which can be used to practice this invention.

The shaft 2 can be the same as the shaft for most golf clubs, i.e. a hollow, tubular steel alloys, boron alloys, titanium alloys, graphite, wood and composites.

The clubhead 3 can be any one of the unlimited styles and shapes of golf clubs for the iron and wood applications, with no specific type being required to practice this invention.

The preferred method of creating the hardened surface layer is by a micro-welding process, and more particularly by what is referred to as electro-static alloying, also referred to as electro-static deposition. This is a process which was generally described in Sheldon U.S. Pat. No. 4,405,851, dated Sep. 20, 1983, along with the apparatus to accomplish the process.

The micro-welding process is not a coating process and it does not simply deposit a pure coating of whatever electrode material is used. Since both the electrode and the surface of the substrate are briefly melted by the electrical pulse, the deposit consists of a fused alloy of the substrate face and material transferred from the electrode. The composition of the fused layer then varies from the original composition of the clubface substrate beneath the weld diffusion zone to a complex substrate-electrode alloy in the diffusion zone and approaches the composition of the electrode itself at the outer surface of the clubface.

Material generally referred to as cermets, which is a ceramic and metal combination, as well as pure forms of metal (nickel, cobalt, molybdenum, chromium, etc.), work particularly well as an electrode material. Additionally, a binder material is generally used through known metallurgy powder techniques to assist in the binding process, the binder material generally comprising approximately three percent (3%) to thirty percent (30%) of the compound. If a cermet electrode is used, it is then alloyed with the original clubface metal, as described above, to form an indistinguishable complex alloy in which separate particles are indistinguishable and the resulting compound is uniform and homogeneous.

Other electrode materials can and have been used, such as: molybdenum; tungsten; columbium; titanium; zirconium; hafnium; tantalum; gold; nickel; silver; cobalt; copper; aluminum; chromium; stainless steels; iridium; platinum; palladium; niobium; iron and its alloys, such as steel and so called super alloys with high nickel or cobalt content.

While it should be noted that pure forms of the metal carbides or borides are not generally used, but instead, electrodes are produced using well-known powder metallurgy techniques in which a nickel or cobalt binder is used to bond or cement the powdered carbide or boride material to a desired electrode shape.

The resulting surface is very uniform in nature in that there are no discrete hard particles. An example of the uniformity is shown in "Electro-Spark Deposition—A Technique for Producing Wear Resistant Coatings", authored by Sheldon, G. L.; Johnson, R. N.; ASME Publications: *Wear of Materials*, pp. 388–396, 1985.

The rapid quenching of the transferred electrode material as it is cooled by the mass of the club creates special highly desirable metallurgical properties in the weld overly such as high hardness and a very fine crystal structure that may even be amorphous or free of crystallinity.

The electrode material is specially chosen to be of very high hardness. Especially useful for the electrode are the carbides of various metal such as tungsten carbide, titanium carbide, chromium carbide and other well-known metallic carbides. These are some of the hardest material known to man and in some instances approach the hardness of diamond.

Mixtures of the above named materials can also be used in the electrodes to achieve different desirable properties. For example, a combination of titanium carbide and tungsten carbide powder with a nickel or cobalt binder has been found to give a very wear resistant surface. Other combinations may include other carbides, nitrides or oxides of metal such as chromium carbide or molybdenum carbide for corrosion resistance or titanium nitride for other certain desirable properties.

The combination of the high hardness that is inherent in the chemical nature of the electrode itself and the hardness resulting from the rapid quenching, imparts a very desirable condition to the weld overlay as applied to the clubface. This is an extremely wear resistant coating that will last many times longer than the original clubface material. Test have shown, for example, that using a titanium carbide surface on a titanium metal can increase the wear resistance of this material by a factor of as much as over one thousand times.

For the electro-deposition method contemplated by this invention, the transfer of material from the electrode to the surface of the clubface is generally regarded to occur through gaseous and molten or globular transfer.

There are other possible ways to apply the carbide material to the outer surface of the clubface, such as by detonation gun, flame spray, metalizing, although the preferred method is by electro-spark alloying, also referred to as electro-spark deposition.

While the preferred embodiment for the invention has been described in detail, those familiar with the art to which this invention relates will recognize various alternative designs and embodiments for carrying out the invention, as defined by the claims which follow.

The invention claimed is:

1. A golf club comprised of:

a. a shaft;

b. a grip affixed to and around one end of said shaft;

c. a metal clubhead affixed to said shaft at an end of the shaft opposite the grip and which includes a clubface, a sole and a back portion; and d. in which an outer surface of the clubface is comprised of a relatively smooth and substantially homogeneous combination of an electrode material which is alloyed with and becomes part of a base metal comprising the remainder of the clubhead and said electrode material being deposited on the clubface by electro-spark deposition.

2. A golf club as recited in claim 1 wherein the compound is a combination of a metal and a ceramic material.

3. A golf club as recited in claim 1 wherein the compound is titanium carbide.

4. A golf club as recited in claim 1 wherein the compound is molybdenum carbide.

5. A golf club as recited in claim 1 wherein the compound is molybdenum.

6. A golf club as recited in claim 1 wherein the compound is nickel.

7. A golf club comprised of:

a. a shaft;

b. a grip affixed to and around one end of said shaft;

c. a metal clubhead affixed to said shaft at an end of the shaft opposite the grip, and which includes a clubface, a sole and a back portion; and d. in which an outer surface of the clubface is comprised of a substantially harder material comprising a relatively smooth and substantially homogeneous combination of an electrode material which is alloyed with and becomes part of a base metal comprising the remainder of the clubhead and which is received by the clubface by electro-spark deposition.

8. A golf club as recited in claim 7 wherein a combination of a metal and a ceramic material is a material that is electro-sparked onto the outer surface of the clubface.

9. A golf club as recited in claim 7 wherein titanium carbide is a material electro-sparked onto the outer surface of the clubface.

10. A golf club as recited in claim 7 wherein molybdenum carbide is a material that is electro-sparked onto the outer surface of the clubface.

11. A golf club as recited in claim 7 wherein molybdenum is a material that is electro-sparked onto the outer surface of the clubface.

12. A golf club as recited in claim 7 wherein nickel is a material that is electro-sparked onto the outer surface of the clubface.

13. A clubhead for use in golf which comprises the following:

a. a metal clubhead for affixing to a shaft at an end of the shaft opposite a grip, and which includes a clubface, a sole and a back portion; and b. in which an outer surface of the clubface is comprised of a relatively smooth and substantially homogeneous combination of an electrode material which is alloyed with and becomes part of a base metal comprising the remainder of the clubhead and said electrode material being deposited on the clubface by electro-spark deposition.

* * * * *